US010424890B2

(12) United States Patent
Hoppe et al.

(10) Patent No.: US 10,424,890 B2
(45) Date of Patent: Sep. 24, 2019

(54) CRIMPING TOOL

(71) Applicant: MILWAUKEE ELECTRIC TOOL CORPORATION, Brookfield, WI (US)

(72) Inventors: Christopher S. Hoppe, Milwaukee, WI (US); Anthony S. Graykowski, Port Washington, WI (US); Mark W. Cors, St. Francis, WI (US); Steven W. Hyma, Milwaukee, WI (US); Grant Thomas Squiers, Cudahy, WI (US); Benjamin Roers, Alexandria, MN (US); Michael Stearns, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 203 days.

(21) Appl. No.: 15/298,398

(22) Filed: Oct. 20, 2016

(65) Prior Publication Data

US 2017/0110842 A1 Apr. 20, 2017

Related U.S. Application Data

(60) Provisional application No. 62/243,983, filed on Oct. 20, 2015.

(51) Int. Cl.
*H01R 43/042* (2006.01)

(52) U.S. Cl.
CPC ..... *H01R 43/0421* (2013.01)

(58) Field of Classification Search
CPC ..... H01R 43/00; H01R 43/22; H01R 43/26; H01R 43/0421
See application file for complete search history.

(56) References Cited

U.S. PATENT DOCUMENTS

| | | | | |
|---|---|---|---|---|
| 4,521,963 | A * | 6/1985 | Lind | B23D 23/00 137/635 |
| 6,698,090 | B1 * | 3/2004 | Hsu | H01R 43/042 29/751 |
| 8,006,372 | B2 | 8/2011 | Caveney et al. | |
| 2004/0163238 | A1 * | 8/2004 | Holliday | B25B 27/10 29/761 |
| 2005/0223548 | A1 * | 10/2005 | Chen | H01R 43/0421 29/747 |
| 2011/0252633 | A1 * | 10/2011 | Dierks | G02B 6/3807 29/705 |

* cited by examiner

*Primary Examiner* — Carl J Arbes
(74) *Attorney, Agent, or Firm* — Reinhart Boerner Van Deuren s.c.

(57) ABSTRACT

A crimping tool, for attaching at least one wire to a connector, includes a housing, a first handle coupled to the housing, and a second handle coupled to the housing and movable relative to the first handle. The crimping tool also includes a working head coupled to the housing opposite the first and second handles. The working head includes an upper wall, an end wall, and a gap defined between the upper wall and the end wall. The crimping tool also includes a punch assembly slidable along the working head toward the end wall in response to movement of the second handle toward the first handle. The punch assembly is visible through the gap as the punch assembly slides toward the end wall.

20 Claims, 9 Drawing Sheets

CRIMPING TOOL

CROSS-REFERENCE TO RELATED APPLICATIONS

This application claims priority to U.S. Provisional Patent Application No. 62/243,983 filed on Oct. 20, 2015, the entire content of which is incorporated herein by reference.

BACKGROUND

The present disclosure relates to crimping tools and more particularly to crimping tools for terminating wires with a connector.

Crimping tools can be used to secure a connector to the ends of multiple wires. Some crimping tools provide side access to the working area of the crimping tool for the connector and wires. The entrance aperture and passage leading to the working area of the crimping tool may not be visible to a user from above, e.g., visibility of the user may be blocked from above such when the user is crimping the tool for performing the crimping operation by an upper wall of the tool.

SUMMARY

The disclosure provides, in one aspect, a crimping tool for attaching at least one wire to a connector. The crimping tool includes a housing, a first handle coupled to the housing, and a second handle coupled to the housing and movable relative to the first handle. The crimping tool also includes a working head coupled to the housing opposite the first and second handles. The working head includes an upper wall, an end wall, and a gap defined between the upper wall and the end wall. The crimping tool also includes a punch assembly slidable along the working head toward the end wall in response to movement of the second handle toward the first handle. The punch assembly is visible through the gap as the punch assembly slides toward the end wall.

The disclosure provides, in another aspect, a crimping tool including a housing, a first handle coupled to the housing, and a second handle coupled to the housing. The second handle is movable relative to the first handle. The crimping tool also includes a working head coupled to the housing opposite the first and second handles, and a punch assembly slidable relative to the working head along a longitudinal axis. The working head is rotatable about the longitudinal axis relative to the housing between a first orientation and a second orientation.

The disclosure provides, in another aspect, a hand tool including a housing, a working head coupled to the housing, and a pushing member slidable within the working head along a longitudinal axis. The working head and the pushing member are rotatable about the longitudinal axis relative to the housing between a first orientation and a second orientation offset about 180 degrees from the first orientation.

Referring to the FIGURES generally, embodiments of a crimping tool are illustrated. In various illustrated embodiments, the crimping tools illustrated in the FIGURES may allow for insertion of a connector and wires to be coupled to the connector into the working area of the crimping tool from above, thus allowing user visibility of the entrance to the working area and the connector and wires when the user is in position relative to the tool to perform a crimping operation. Such visibility may provide for easier location of the connector and wires in the working area of the tool for easier and more accurate crimping operations. Additionally, in various illustrated embodiments, the crimping tools illustrated in the FIGURES provide different working area portions to couple wires to differently sized connectors. The different working areas may be reconfigured relative to the handles of the crimping tool such that one size working area may be selected and rotated to an upper configuration relative to the handle providing user visibility to the working area as described above, and then when another working area is to be used, this other working area may be rotated into an upper configuration relative to the handle providing user visibility to the working area as described above.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
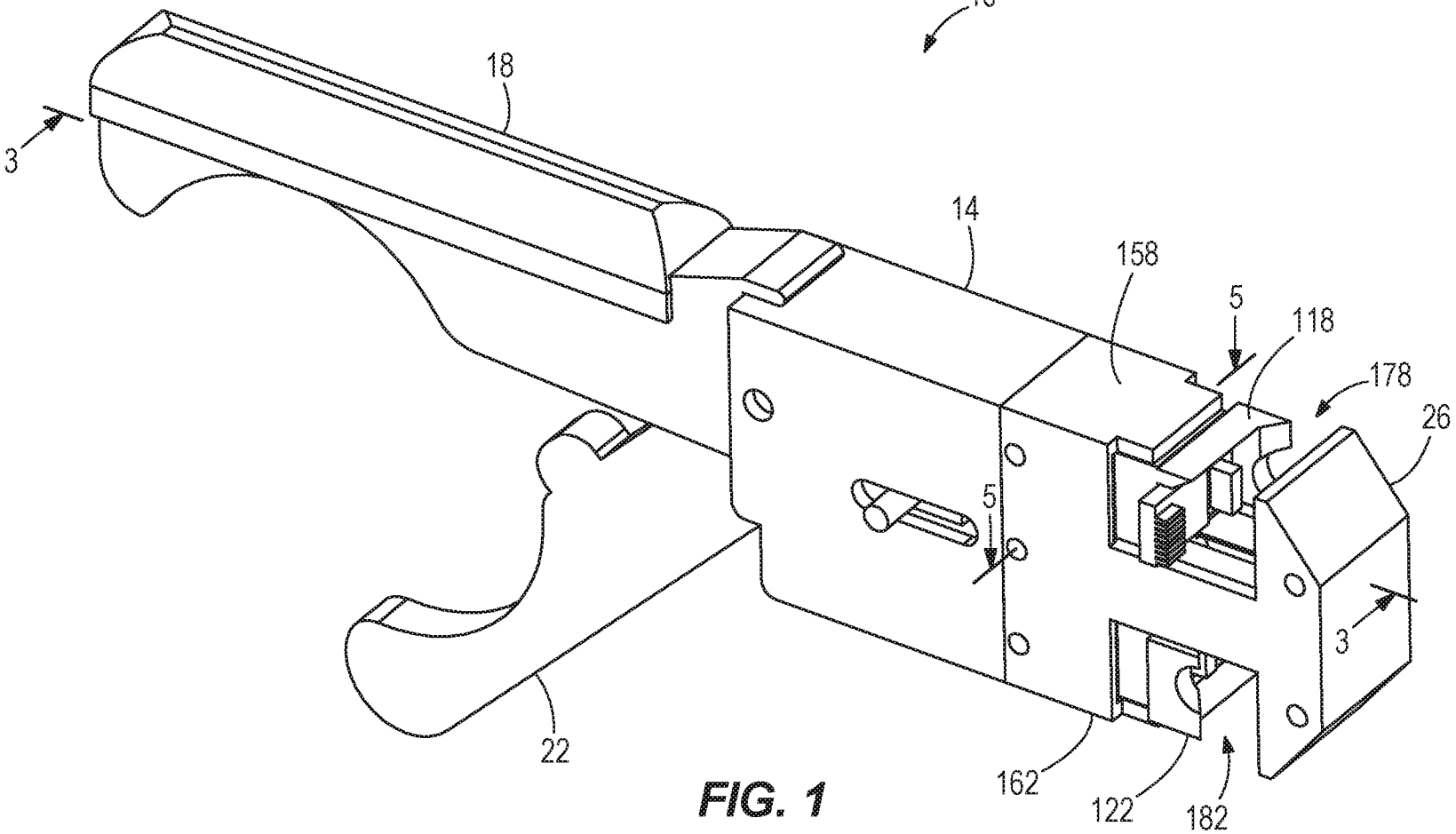
FIG. 1 is a perspective view of a crimping tool according to one embodiment.

FIG. 1 illustrates a hand tool 10, which is a crimping tool in the illustrated embodiment. The crimping tool 10 includes a housing 14, a first handle 18, a second handle 22, and a working head 26. In the illustrated embodiment, the first handle 18 is a fixed handle (i.e. the first handle 18 is fixed relative to the housing 14), and the second handle 22 is movable relative to the first handle 18. In other embodiments, both handles 14, 18 may be movable relative to the housing 14 such that the crimping tool 10 may be actuated in a scissors-like manner.

Figure 2:
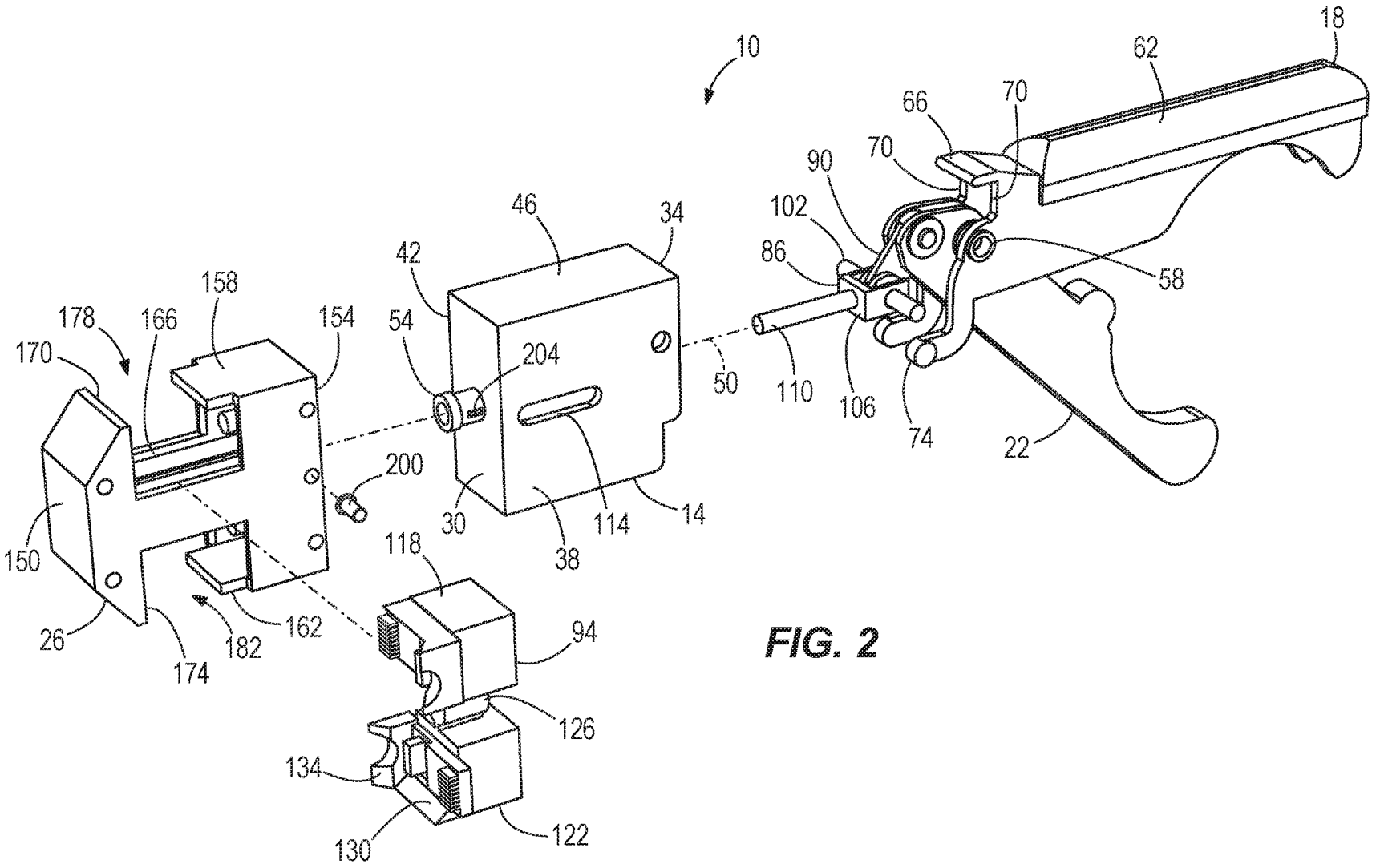
FIG. 2 is an exploded view of the crimping tool of FIG. 1.

With reference to the orientation of the crimping tool 10 illustrated in FIG. 2, the housing 14 includes a front end 30, a back end 34, opposite first and second side walls 38, 42, and an upper wall 46. The housing 14 is disposed between the handles 18, 22 and the working head 26 and defines a longitudinal axis 50 extending between the front and back ends 30, 34. The housing 14 further includes a projection 54 extending from the front end 30. The working head 26 receives the projection 54 to couple the working head 26 to the housing 14.

Figure 3:
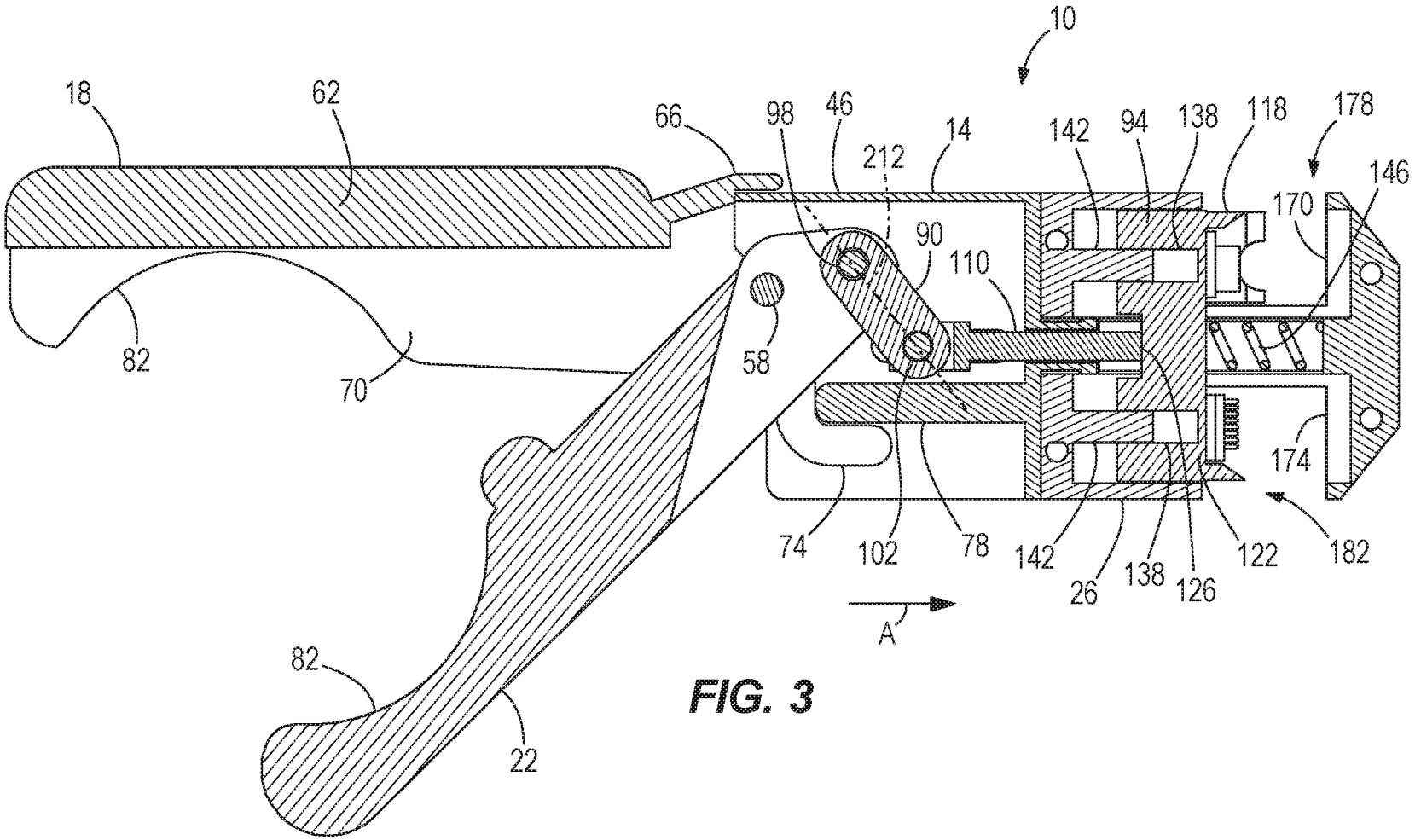
FIG. 3 is a cross-sectional view of the crimping tool of FIG. 1, taken along line 3-3 in FIG. 1.
Figure 4:
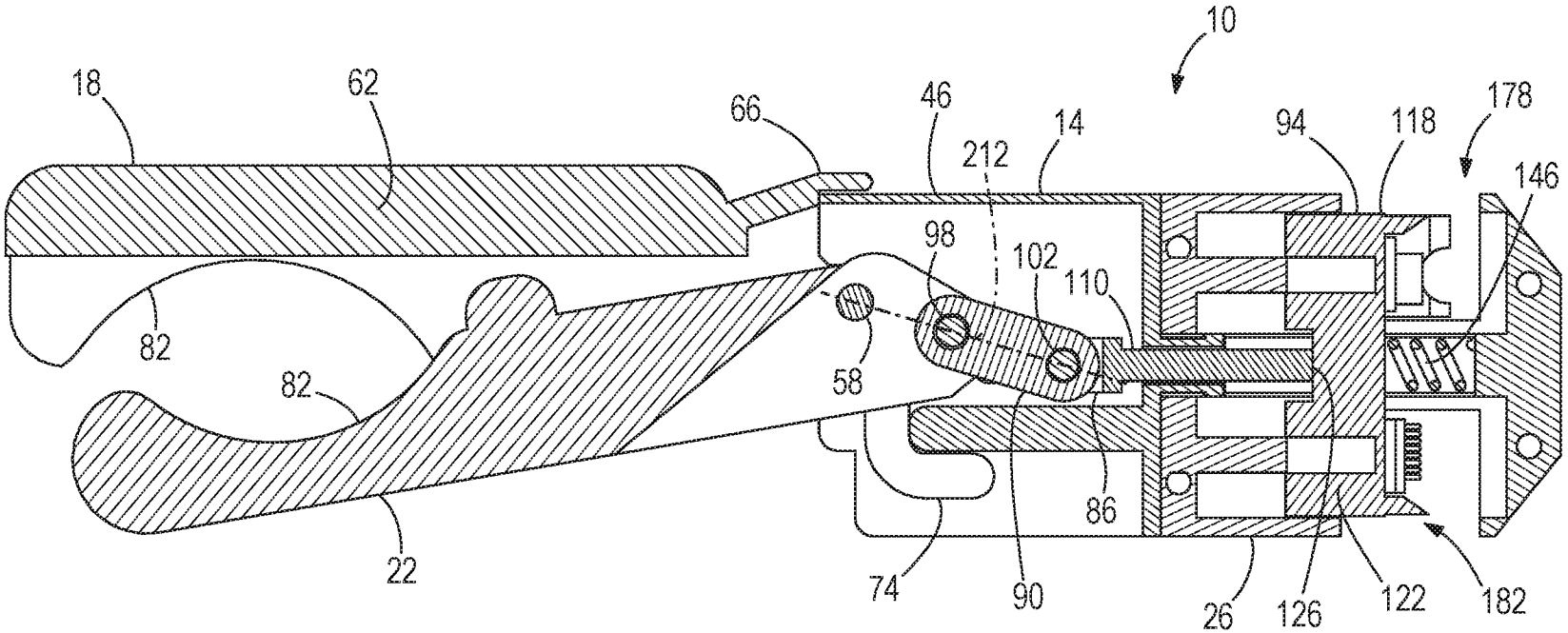
FIG. 4 is a cross-sectional view of the crimping tool of FIG. 3, illustrated in an actuated configuration.

With reference to FIGS. 2 and 3, the first handle 18 and the second handle 22 are coupled to the housing 14, proximate the back end 34, by a first pin 58. The first handle 18 includes a grip portion 62, an upper bracket 66, and a pair of spaced walls 70 that collectively define a lower bracket 74. The upper bracket 66 engages the upper wall 46 of the housing 14, and the lower bracket 74 engages an interior shelf 78 located within the housing 14 (FIG. 3). The first pin 58 and the engagement between the brackets 66, 74 and the housing 14 inhibit movement of the first handle 18 relative to the housing 14. In the illustrated embodiment, the second handle 22 is received between the two walls 70 of the first handle 18 and is pivotable relative to the first handle 18 about the first pin 58. Each of the illustrated handles 18, 22 includes an arcuate relief 82 to provide space between the handles 18, 22 (e.g., to accommodate a user's fingers) when the crimping tool 10 is in an actuated configuration (FIG. 4).

The illustrated crimping tool 10 further includes a drive assembly 86, a link 90 extending between the drive assembly 86 and the second handle 22, and a punch assembly 94 engaged with the drive assembly 86 (FIG. 2). The link 90 is pivotally coupled to the second handle 22 at one end by a second pin 98, and the link 90 is pivotally coupled to the drive assembly 86 at its opposite end by a third pin 102. The drive assembly 86 has a clevis 106 that receives the third pin 102 and a drive pin 110 that extends from the clevis 106. In the illustrated embodiment, the drive pin 110 extends along the longitudinal axis 50. The third pin 102 extends through slots 114 formed in the side walls 38, 42 of the housing 14. The engagement of the third pin 102 with the slots 114 generally restricts movement of drive assembly 86 to sliding movement along the longitudinal axis 50.

With continued reference to FIG. 2, the punch assembly 94 includes a first punch 118, a second punch 122, and a connecting portion 126 disposed between the first punch 118 and the second punch 122. In the illustrated embodiment, each of the punches 118, 122 includes a first chamfered guide surface 130 and a second chamfered guide surface 134. The guide surfaces 130, 134 are engageable with a connector to facilitate guiding the connector into a proper position during a crimping operation. In other embodiments, only one of the first and second punches 118, 122 may include guide surfaces 130, 134, or the guide surfaces 130, 134 may be omitted.

The crimping tool 10 is operable to crimp or terminate wires, such as data/communications wires, with a desired connector. In the illustrated embodiment, the first punch 118 is configured to crimp wires into a first type of connector, and the second punch 122 is configured to crimp wires into a second type of connector that is different from the first type of connector. For example, the punches 118, 122 may be differently sized, may be able to crimp a different number or gauge of wires, may include one or more cutting blades, etc. In some embodiments, the first punch 118 may be configured to crimp wires into an RJ45 type connector, and the second punch 122 may be configured to crimp wires into an RJ11 type connector.

Referring to FIGS. 3 and 4, the punch assembly 94 is slidably received within the working head 26. The drive pin 110 is engageable with the connecting portion 126 to move the punch assembly 94 from an open position (FIG. 3) to an actuated position (FIG. 4) in response to movement of the second handle 22 toward the first handle 18. In the illustrated embodiment, each of the punches 118, 122 includes an axial bore 138 that receives a corresponding post 142 on the working head 26. The posts 142 guide and stabilize the punch assembly 94 as it slides between the open and actuated positions. A biasing member 146, which is a coil spring in the illustrated embodiment, is disposed within the working head 26 and engages the connecting portion 126 to bias the punch assembly 94 toward the open position.

With reference to FIG. 2, the working head 26 includes a front end 150, a back end 154, a first wall 158, and a second wall 162. The working head 26 further includes a center channel 166 extending along the longitudinal axis 50 and first and second stop surfaces 170, 174 extending radially outwardly from the center channel 166, proximate the front end 150. A first gap or opening 178 is defined between the first wall 158 and the first stop surface 170, and a second gap or opening 182 is defined between the second wall 162 and the second stop surface 174. The first punch 118 is visible through the first gap 178 from the exterior of the crimping tool 10, and the second punch 122 is visible through the second gap 182 from the exterior of the crimping tool 10 (FIG. 1). With reference to FIG. 2, in the illustrated embodiment, the working head 26 and the punch assembly 94 are rotatable about the longitudinal axis 50 between a first orientation in which the first wall 158 of the working head 26 is generally adjacent the upper wall 46 of the housing 14 and a second orientation (not shown) in which the second wall 162 of the working head 26 is general adjacent the upper wall 46 of the housing 14. As such, the first orientation and the second orientation are rotationally offset by about 180 degrees.

Figure 5:
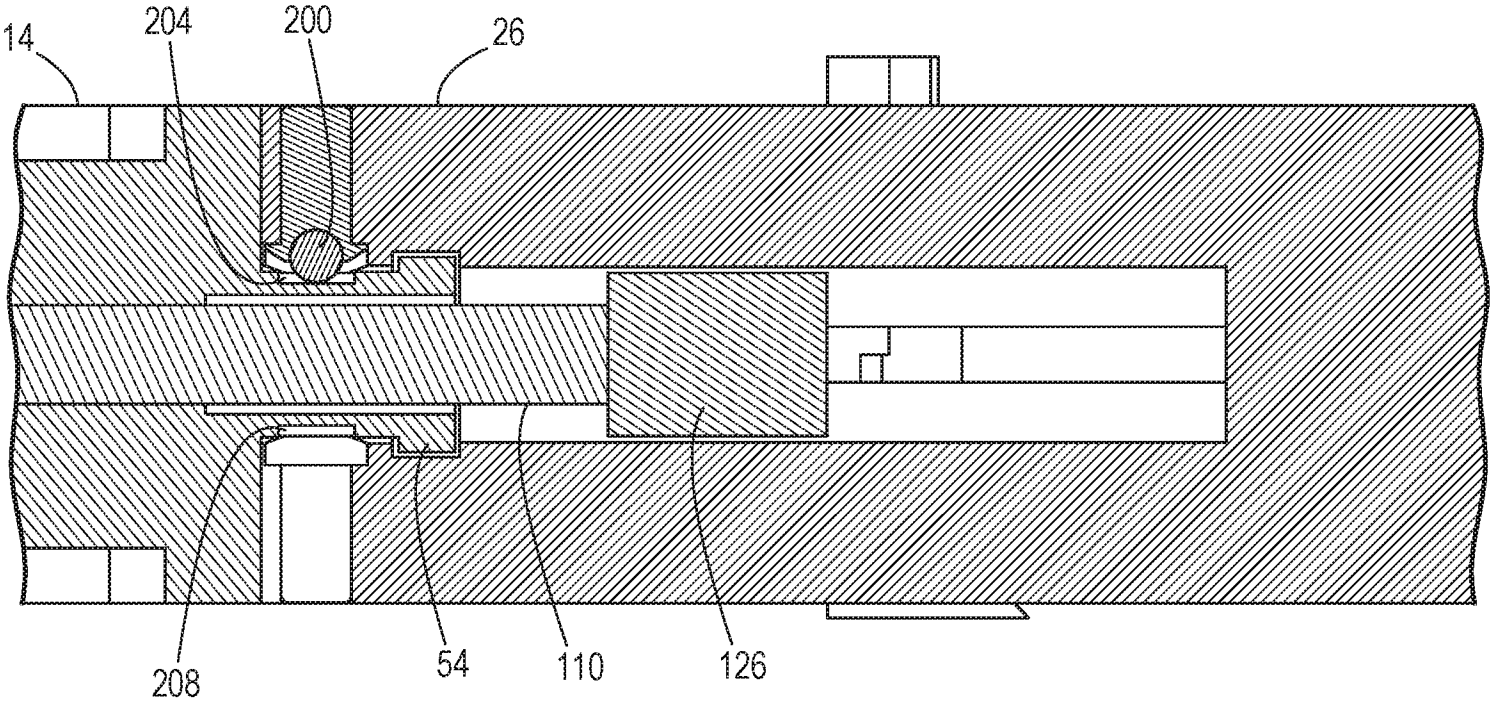
FIG. 5 is a cross-sectional view of the crimping tool of FIG. 1, taken along line 5-5 in FIG. 1.

The illustrated working head 26 further includes a detent 200 (FIG. 5) that is engageable with a first recess 204 on the projection 54 when the working head 26 is in the first orientation and that is engageable with a second recess 208 on the projection 54 when the working head 26 is in the second orientation. The engagement between the detent 200 and the first recess 204 resists rotation of the working head 26 out of the first orientation, and the engagement between the detent 200 and the second recess 208 resists rotation of the working head 26 out of the second orientation. In other embodiments, the working head 26 may include the recesses 204, 208, and the projection 54 may include the detent 200. In some embodiments, one or more additional detents and/or recesses may be provided.

In operation, a user inserts a connector of a first type (not shown) into the working head 26 between the first punch 118 and the first stop surface 170. The user aligns the wires to be crimped (not shown) with the appropriate terminals of the connector. Next, the user squeezes the handles 18, 22 together to pivot the second handle 22 toward the first handle 18. As the second handle 22 pivots, it drives the drive assembly 86 in the direction of arrow A (FIG. 3). The drive pin 110 bears against the connecting portion 126 to move the punch assembly 94 toward the actuated position (FIG. 4), compressing the biasing member 146. During this process, the user can observe the connector and the wires from the top side of the crimping tool 10 by looking through the first gap 178. If the user notices that the wires are not properly aligned with the connector before the crimp is completed, the user may release pressure on the handles 18, 22. The biasing member forces 146 the punch assembly 94 to return to the open position (FIG. 3), which in turn causes the second handle 22 to pivot away from the first handle 18.

If the user continues the crimping operation, a line 212 extending through the centers of the second and third pins 98, 102 passes over the center point of the first pin 58 (FIG. 4). Accordingly, the biasing force of biasing member 146, which previously acted through the punch assembly 94, drive assembly 86, and link 90 to bias the second handle 22 away from the first handle 18, now biases the second handle 22 toward the first handle 18. This over-center arrangement may indicate to the user that the crimping operation is completed. The user then applies an opening force to the handles 18, 22 until the line passes 212 back over the center point of the first pin 58 (i.e. the equilibrium point). The biasing member 146 then returns the punch assembly 94 and the second handle 22 to the open position. Because the equilibrium point occurs near the end of travel of the punch assembly 94, the user may abort the crimping operation with relative ease throughout the majority of the crimping operation.

If the user desires to perform a crimping operation on a differently sized connector, the user may grasp the working head 26 and rotate it to the second orientation by overcoming the engagement force of the detent 200 and first recess 204. Once the working head 26 is in the second orientation, the user inserts a connector of a second type (not shown) into the working head 26 between the second punch 122 and the second stop surface 174. The user may then commence a crimping operation as described above. During this process, the user can observe the connector and the wires from the top side of the crimping tool 10 by looking through the second gap 182.

FIGS. 6-9 illustrate a hand tool 1010, which is a crimping tool in the illustrated embodiment. The crimping tool 1010 includes features similar to the crimping tool 10 described above with reference to FIGS. 1-5, and like components have been given like reference numbers plus 1000. The following description focuses primarily on the differences between the crimping tool 10 of FIGS. 1-5 and the crimping tool 1010 of FIGS. 6-9.

Figure 7:
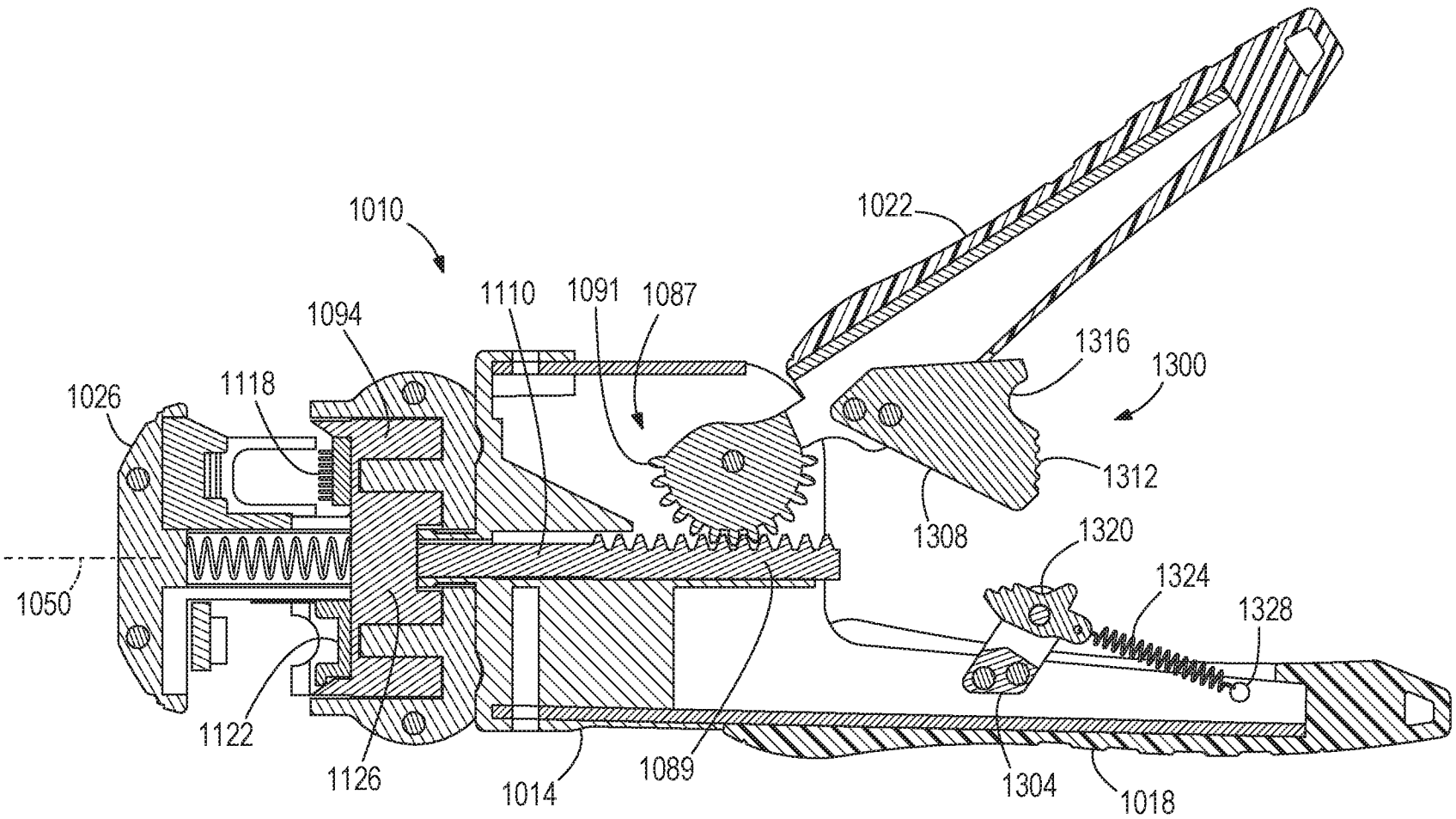
FIG. 7 is a cross-sectional view of the crimping tool of FIG. 6, taken along line 7-7 in FIG. 6
Figure 8:
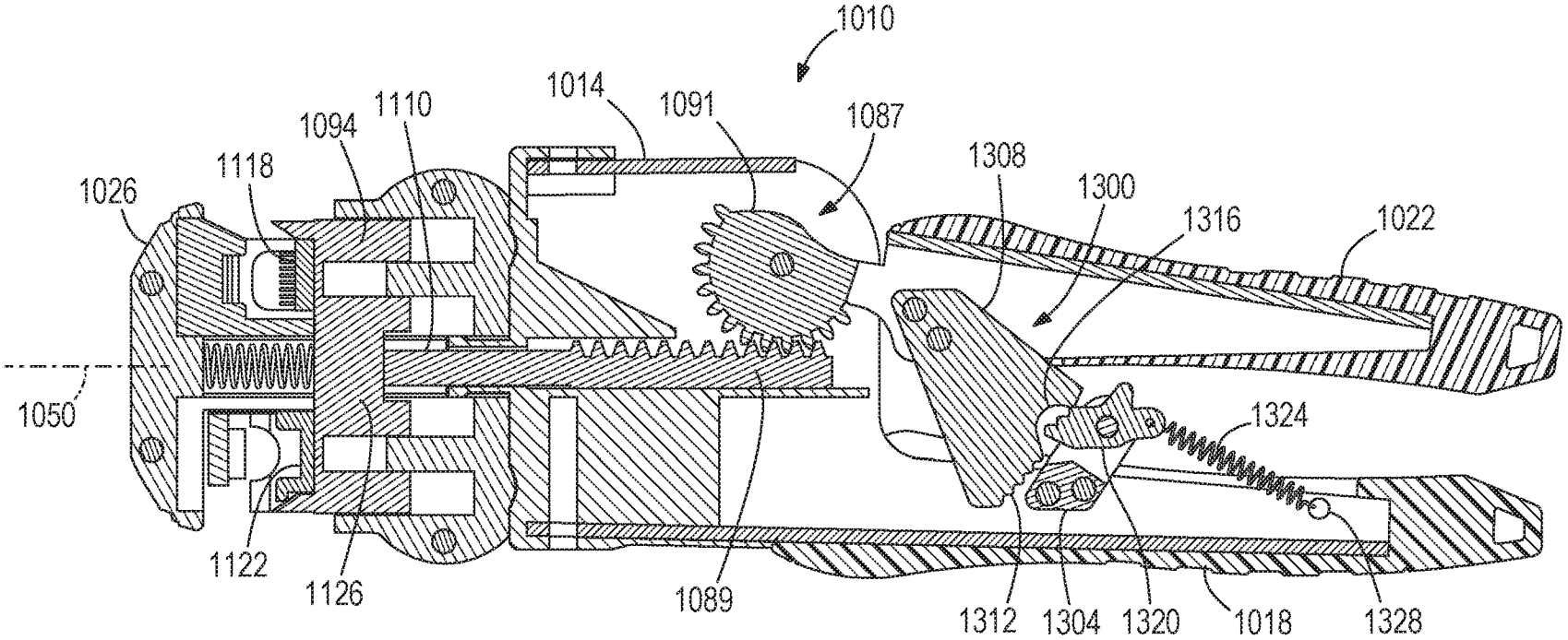
FIG. 8 is a cross-sectional view of the crimping tool of FIG. 7, illustrated in an actuated configuration.

With reference to FIGS. 7 and 8, the illustrated crimping tool 1010 has a drive assembly 1087 including a rack member 1089 and a pinion 1091 in meshed engagement with the rack member 1089. The rack member 1089 is coupled to the drive pin 1110 such that the rack member 1089 and the drive pin 1110 are movable together along the longitudinal axis 1050. The pinion 1091 is fixed to the second handle 1022 for rotation therewith about the pivot axis of the second handle 1022. In some embodiments, the rack member 1089 and the drive pin 1110 are integrally formed together as a single piece. In other embodiments, the drive pin 1110 may be fixed to the rack member 1089. In yet other embodiments, the rack member 1089 may be separable from the drive pin 1110 and may bear against the drive pin 1110 to impart axial movement to the drive pin 1110.

With continued reference to FIGS. 7 and 8, the crimping tool 1010 further includes a handle lock assembly 1300. A first member 1304 of the handle lock assembly 1300 extends from the first handle 1018 in a direction generally toward the second handle 1022. A second member 1308 of the handle lock assembly 1300 extends from the second handle 1022 in a direction generally toward the first handle 1018. The second member 1308 includes a plurality of teeth 1312 and a release recess 1316 adjacent the teeth 1312. The first member 1304 supports a pawl 1320 that is engageable with the teeth 1312. A spring 1324 extends from the pawl 1320 to an anchor point 1328 on the first handle 1018.

Figure 9:
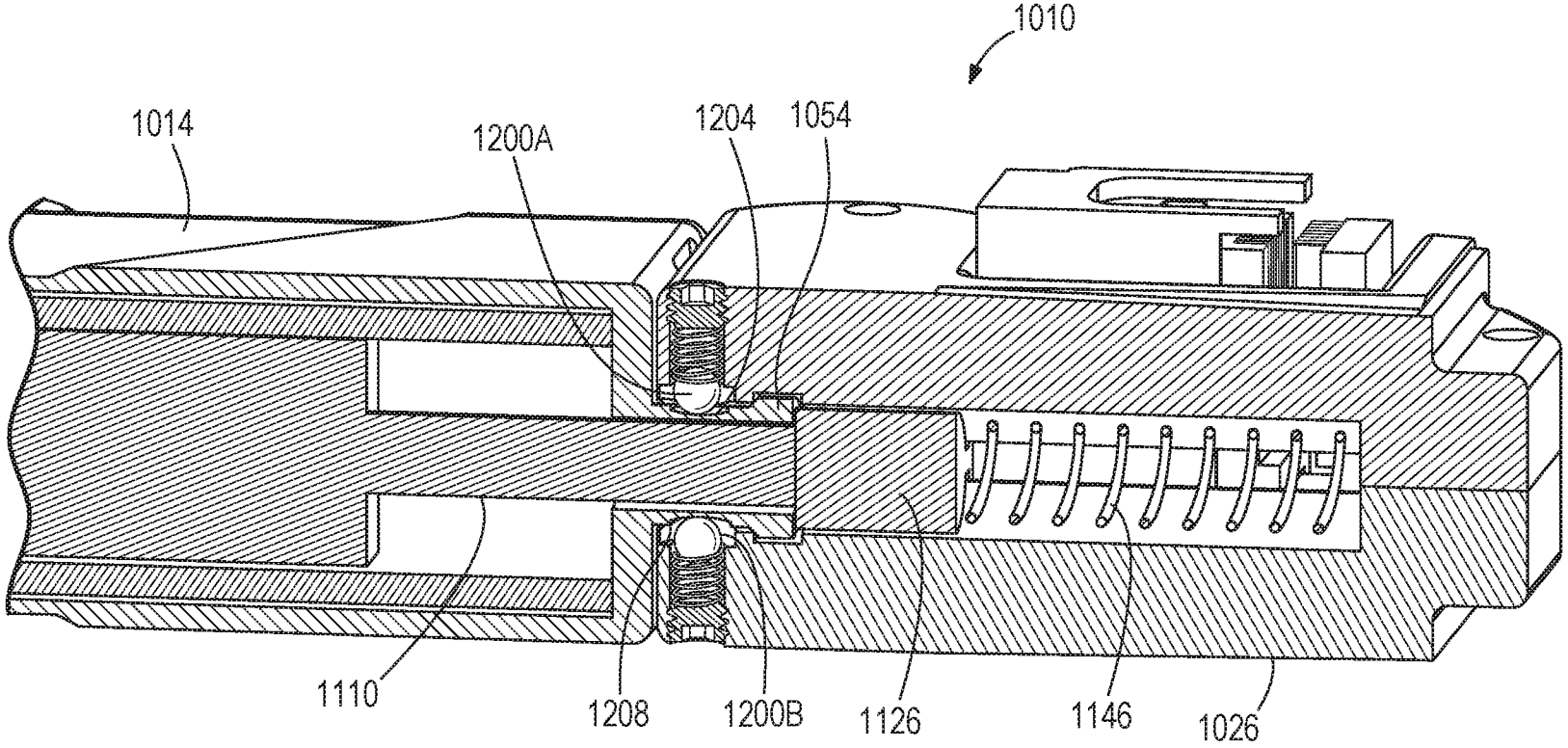
FIG. 9 is a cross-sectional view of a portion of the crimping tool of FIG. 6, taken along line 9-9 in FIG. 6.

Referring to FIG. 9, the working head 1026 of the crimping tool 1010 includes a first detent 1200A that is engageable with a first recess 1204 on the projection 1054 and a second detent 1200B that is engageable with a second recess 1208 on the projection 1054 when the working head 1026 is in the first orientation. When the working head 1026 is rotated 180 degrees to the second orientation, the first detent 1200A is engageable with the second recess 1208, and the second detent 1200B is engageable with the first recess 1204. The engagement between the detents 1200A, 1200B and the recesses 1204, 1208 resists rotation of the working head 1026 out of the first orientation and the second orientation, respectively. In other embodiments, the working head 1026 may include the recesses 1204, 1208, and the projection 1054 may include the detents 1200A, 1200B. In some embodiments, one or more additional detents and/or recesses may be provided, or other means may be provided for retaining the working head 1026 in the respective first and second orientations.

Figure 6:
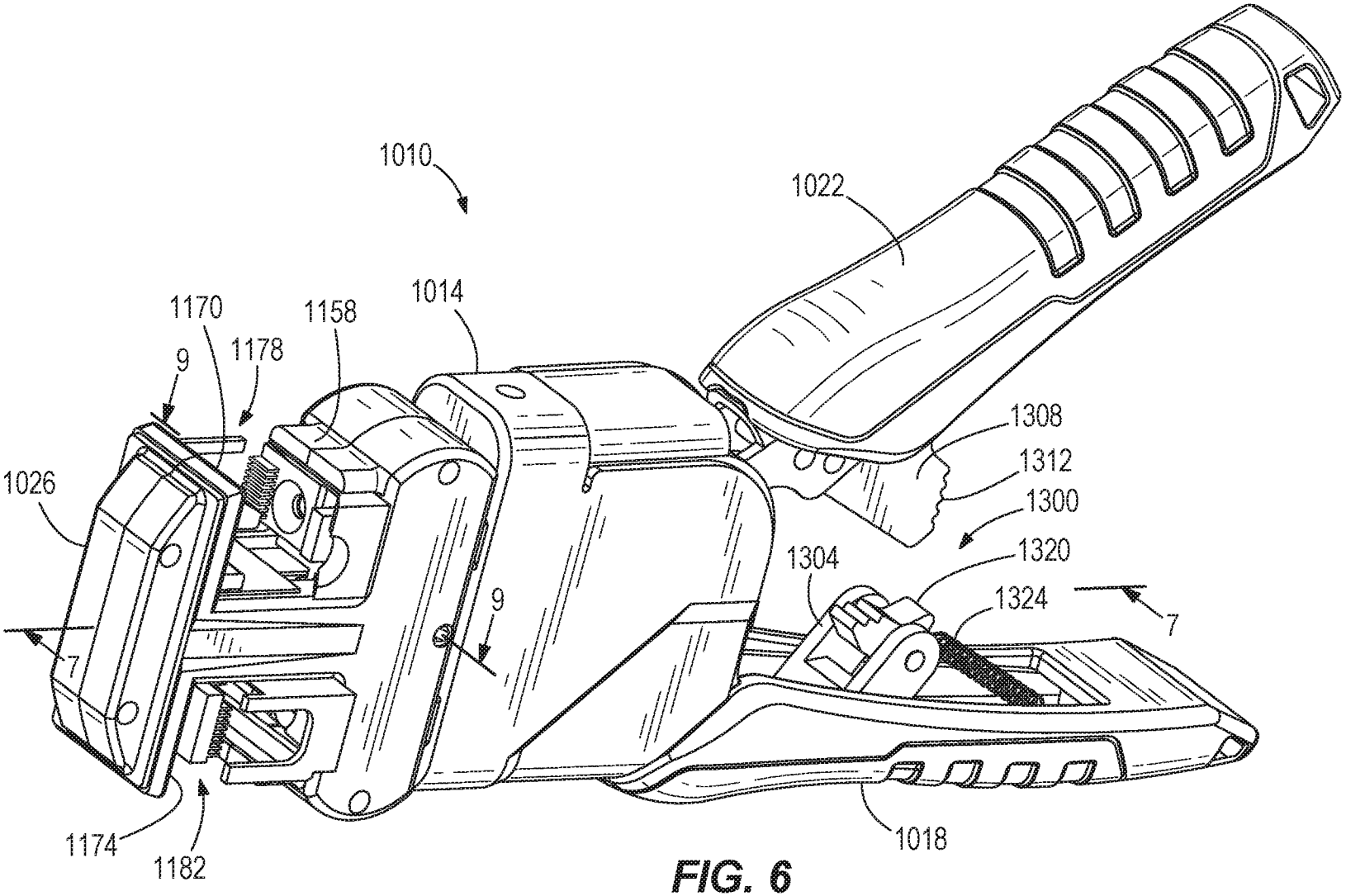
FIG. 6 is a perspective view of a crimping tool according to another embodiment.

In operation, a user inserts a connector of a first type (not shown) into the working head 1026 between the first punch 1118 and the first stop surface 1170 (FIGS. 6 and 7). The user then squeezes the handles 1018, 1022 together to pivot the second handle 1022 toward the first handle 1018. As the second handle 1022 pivots, the pinion 1091 rotates, causing the rack member 1089 and the drive pin 1110 to advance in the direction of arrow A. This drives the punch assembly 1094 to perform a crimping operation (FIG. 8). During this process, the user can observe the connector and the wires from the top side of the crimping tool 1010 by looking through the first gap 1178 (FIG. 6).

In addition, as the second handle 1022 pivots toward the first handle 1018, the pawl 1320 incrementally engages with the teeth 1312. This inhibits the second handle 1022 backing away from the first handle 1018 before the crimping operation is complete, even if the user releases pressure on the handles 1018, 1022. Once the crimping operation is complete, the pawl 1320 enters the release recess 1316 and pivots under the influence of the spring 1324 to release the handles 1018, 1022. The biasing member forces 1146 the punch assembly 1094 to return to the open position (FIG. 7), which in turn causes the second handle 1022 to pivot away from the first handle 1018.

Various features of the disclosure are set forth in the following claims.

What is claimed is:

1. A crimping tool comprising:

a housing;

a first handle coupled to the housing;

a second handle coupled to the housing and movable relative to the first handle;

a working head coupled to the housing opposite the first and second handles; and a punch assembly slidably coupled to the working head along a longitudinal axis;

wherein the punch assembly and the working head are rotatable together about the longitudinal axis of the housing from a first orientation to a second orientation.

2. The crimping tool of claim 1, wherein the punch assembly is slidably coupled to the working head, the punch assembly includes a first punch coupled to a second punch, wherein the first punch is configured to perform a crimping operation on a connector of a first type and the second punch is configured to perform a crimping operation on a connector of a second type.

3. The crimping tool of claim 2, wherein the working head includes an upper wall extending generally parallel to the longitudinal axis, an end wall extending generally perpendicular to the longitudinal axis, and a gap defined between the upper wall and the end wall, and wherein the punch assembly is slidable toward the end wall in response to movement of the second handle toward the first handle.

4. The crimping tool of claim 3, wherein the first punch is visible through the gap as the punch assembly moves toward the end wall.

5. The crimping tool of claim 1, further comprising a drive assembly at least partially disposed within the housing, the drive assembly configured to drive the punch assembly along the longitudinal axis as the second handle moves toward the first handle.

6. The crimping tool of claim 5, wherein the drive assembly includes a rack and pinion.

7. The crimping tool of claim 5, wherein the drive assembly includes an over-center linkage.

8. The crimping tool of claim 5, wherein the drive assembly includes a drive pin coupled to the punch assembly, wherein the punch assembly includes a first punch, a second punch, and a connecting portion coupling the first punch and the second punch, and wherein the drive pin is engageable with the connecting portion to move the punch assembly within the working head along the longitudinal axis.

9. The crimping tool of claim 5, wherein a front end of the housing includes a projection extending from the front end into the working head along the longitudinal axis, the projection including a first recess and a second recess, and wherein the working head includes a detent that is engageable with the first recess when the working head is in the first orientation and that is engageable with the second recess when the working head is in the second orientation.

10. The crimping tool of claim 1, wherein the working head and the pushing member punch assembly are rotatable about the longitudinal axis relative to the housing between a first orientation and a second orientation offset about 180 degrees from the first orientation.

11. A crimping tool for attaching at least one wire to a connector, the crimping tool comprising:

a housing;

a first handle coupled to the housing;

a second handle coupled to the housing and movable relative to the first handle;

a working head coupled to the housing opposite the first and second handles, the working head including an upper wall, an end wall, and a gap defined between the upper wall and the end wall, the working head being rotatable relative to the housing between a first orientation and a second orientation; and a punch assembly slidable along the working head toward the end wall in response to movement of the second handle toward the first handle, the punch assembly being rotatable relative to the housing between a first orientation and a second orientation, wherein the punch assembly is visible through the gap as the punch assembly slides toward the end wall.

12. The crimping tool of claim 11, wherein the punch assembly is slidable along a longitudinal axis, and wherein the working head and the punch assembly are rotatable between the first orientation and the second orientation about the longitudinal axis.

13. The crimping tool of claim 11, wherein the punch assembly is coupled to the working head and comprises a first punch configured to perform a crimping operation on a connector of a first type and a second punch configured to perform a crimping operation on a connector of a second type.

14. The crimping tool of claim 11, further comprising a drive assembly at least partially disposed within the housing, the drive assembly configured to drive the punch assembly toward the end wall as the second handle moves toward the first handle.

15. The crimping tool of claim 14, wherein the drive assembly includes a rack and pinion.

16. The crimping tool of claim 14, wherein the drive assembly includes an over-center linkage.

17. The crimping tool of claim 14, wherein the drive assembly includes a drive pin, wherein the punch assembly includes a first punch, a second punch, and a connecting portion extending between the first punch and the second punch, and wherein the drive pin is engageable with the connecting portion of the punch assembly to move the first punch and the second punch toward the end wall of the working head.

18. The crimping tool of claim 17, wherein the punch assembly is biased toward the drive pin.

19. The crimping tool of claim 11, further comprising a drive pin in the working head that couples with the channel portion between a first punch and a second punch of the punch assembly, the first punch being visible through a first gap on a first side of the drive pin, the first gap being defined between a first upper wall and the end wall, and the second punch being visible through a second gap on a second side of the drive pin, the second gap being defined between a second upper wall and the end wall.

20. A crimping tool, comprising:

a housing;

a first handle coupled to the housing;

a second handle coupled to the housing and movable relative to the first handle;

a working head extending along a longitudinal axis and coupled to the housing at an end opposite of the first and second handles, the working head including an upper wall, an end wall, and a central channel;

a drive pin extending along the longitudinal axis and located within the central channel;

a first punch slidable along the central channel of the working head toward the end wall in response to movement of the second handle toward the first handle, and a second punch slidable along the central channel of the working head toward the end wall in response to movement of the second handle toward the first handle;

wherein the working head, the first punch, and the second punch are rotatable relative to the longitudinal axis of the housing between a first orientation and a second orientation.

* * * * *